United States Patent [19]

Greene

[11] 4,212,740

[45] Jul. 15, 1980

[54] FLOATING WEIR AND STRAINER BASKET CONSTRUCTION

[75] Inventor: Nat Greene, Los Angeles, Calif.

[73] Assignee: KDI American Products, Inc., North Hollywood, Calif.

[21] Appl. No.: 911,713

[22] Filed: Jun. 2, 1978

[51] Int. Cl.[2] ..... E04H 3/20

[52] U.S. Cl. ..... 210/169; 210/242 R

[58] Field of Search ..... 210/169, 242

[56] References Cited

U.S. PATENT DOCUMENTS

| | | | |
|---|---|---|---|
| 3,616,916 | 11/1971 | Greene | 210/169 |
| 3,616,918 | 11/1971 | Diemond | 210/169 |
| 3,633,749 | 4/1970 | Ponosh | 210/169 |

*Primary Examiner*—Theodore A. Granger

*Attorney, Agent, or Firm*—Fulwider, Patton, Rieber, Lee & Utecht

[57] ABSTRACT

An improved floating weir and strainer basket combination for use in a swimming pool skimmer, having a tank adapted to receive the strainer basket and the floating weir in telescoping relation with each other. Accordingly, when the skimmer is suitably positioned in a body of water, the floating weir rests on a pocket of air which enables it to move vertically within the strainer basket in response to changes in water level. To prevent misalignment or disassociation of the floating weir with respect to the strainer basket, a disengageable mechanism is provided for retaining the weir in the basket. In the disclosed embodiment, the disengageable retaining mechanism comprises at least three equally spaced projections disposed on the outer wall surface of the floating weir, and at least three corresponding notches disposed on the inside periphery of a flange on the strainer basket. To position the floating weir within the strainer basket, the projections on the weir are registered with the notches on the basket flange, and the weir is then inserted into the basket until the projections clear the underside of the basket flange. After insertion, the weir is rotated to move the respective projections and notches out of alignment and thereby prevent the floating weir from completely rising above the basket flange.

5 Claims, 7 Drawing Figures

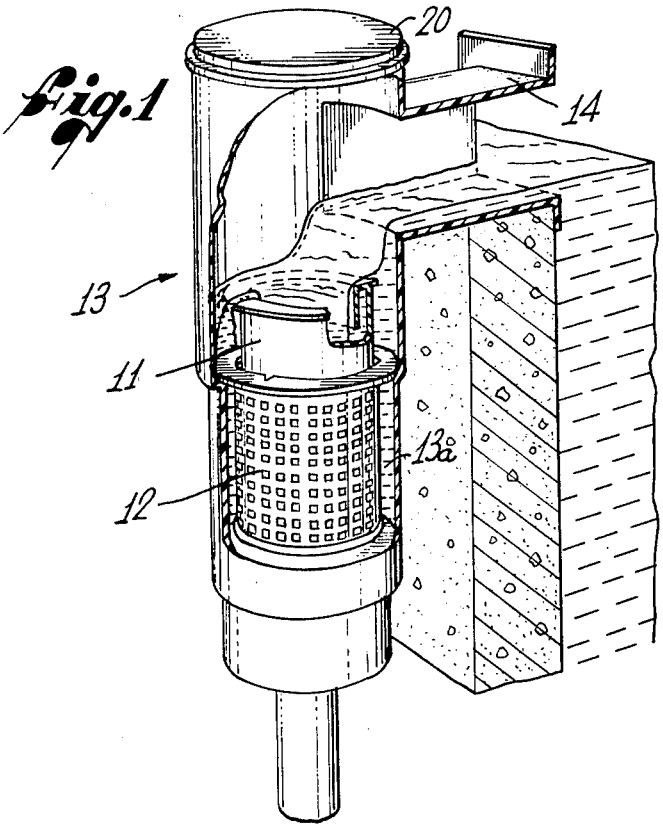
Fig.1
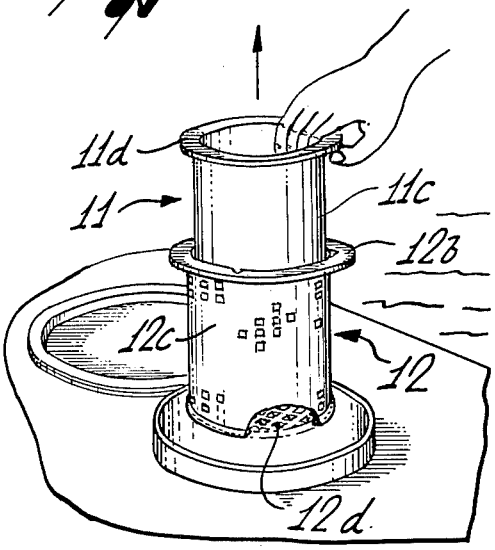
Fig.2
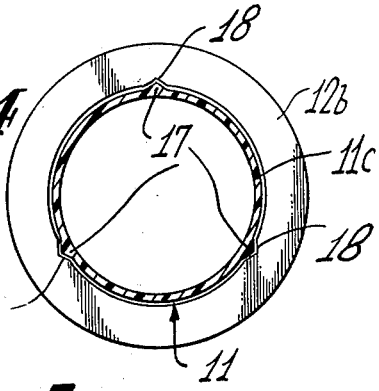
Fig.4
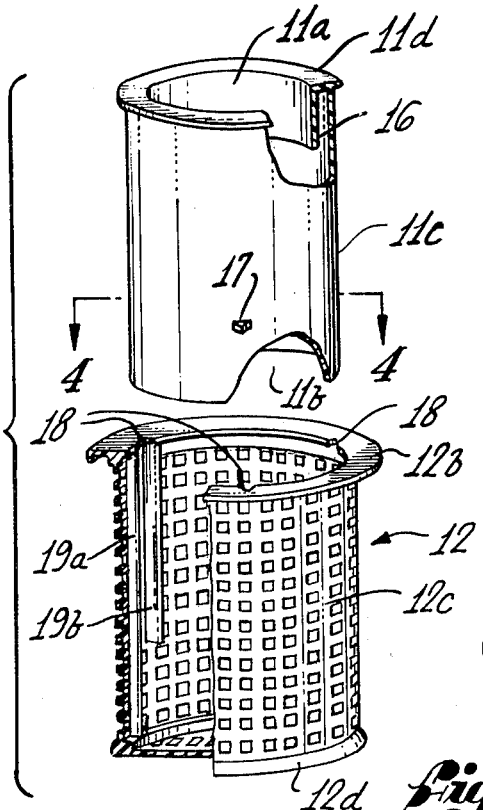
Fig.3
Fig.7
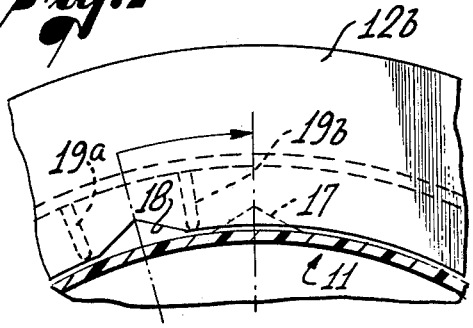
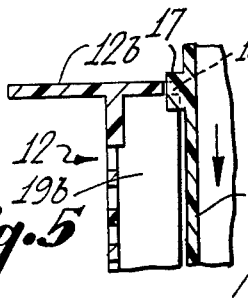
Fig.5
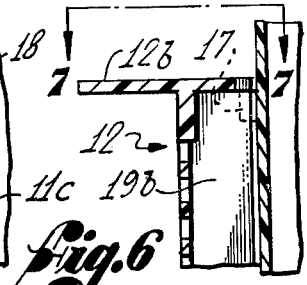
Fig.6

FLOATING WEIR AND STRAINER BASKET CONSTRUCTION

BACKGROUND OF THE INVENTION

This invention relates generally to improvements in skimmer devices for swimming pools and the like, and, more particularly, to a new and improved floating weir and strainer basket combination for use in a pool skimming device.

In removing debris from the surface of swimming pool water, it is known to utilize a self-adjustment, recirculating, overflow system for regulating the flow rate of water into a skimmer device. This form of skimmer device typically includes two component parts: the float member and a fixed support positioned in telescoping relation with each other to permit free upward and downward movement of the float member as the water level in the pool changes.

Together, the two parts form an open chamber in which a quantity of the water is segregated from the main body of pool water. The chamber varies in size with changes in the depth of the water in the pool, and this variation causes upward or downward movement of the float member. By withdrawing water continuously from the chamber, for example, through an outlet pipe connected to a suction pump, a difference between the water levels of the pool and the chamber is created, which, in turn, affects the equilibrium of the float member. The difference in water levels causes the member to float below the water level of the pool but above the water level in the chamber. As a result, a top layer of water spills over the top of the float member and into the chamber, from which it is pumped through the outlet pipe connected to the fixed support. Accordingly, the float member automatically adjusts itself to the difference in water levels created by the withdrawal of water from the chamber. A prior device of this type is disclosed, for example, in U.S. Pat. No. 2,579,304 issued to Crawford.

Although generally unsatisfactory, such prior devices have not always maintained the desired telescoping relation of the float member and the fixed support. For instance, the float member would completely ride above the fixed support or cock to one side of the support, and jam. When jamming of the float member occurs with the suction pump on, the pump can draw air into the pumping system, and damage to rotary seals of the pump can result.

As is also known in the art of skimmer systems, a strainer element can be positioned adjacent to the float member, to intercept and retain leaves and other debris which might clog the outlet pipe connected to the suction pump. The strainer element then rests on the fixed support with respect to which the float member moves. However, in order to remove the accumulated debris, an operator must first remove the float member from the skimmer device and then reach down below the water level to remove the strainer element. Not only is the removal of the strainer a two-step procedure, but the element must be physically handled below the water level during its removal from and installation in the skimmer system.

Hence, those concerned with the development and use of swimming pool skimmers have recognized a significant need for a skimmer in which the float member and strainer element cannot be easily misaligned or disassociated, and from which the strainer element is easily removed for cleaning. The present invention fulfills this need.

SUMMARY OF THE INVENTION

Briefly, and in general terms, the present invention provides a new and improved skimmer device for removing surface debris from swimming pool water or the like, and a new and improved floating weir and strainer basket combination adapted to maintain proper mounting of a floating weir in the skimmer device, and to facilitate removal of the strainer basket therefrom.

Basically, the present invention includes a self-adjusting, recirculating, overflow skimmer device having a tank adapted to receive the floating weir and strainer basket in telescoping relation with each other. Further, the floating weir and strainer basket combination includes means for disengageably retaining the weir in the basket, to prevent disassociation of the weir from the basket, while at the same time permitting free vertical movement of the weir.

More specifically, and in a presently preferred embodiment of the invention, the means for disengageably retaining the weir in the basket comprises a plurality of projections disposed on the outer wall surface of the weir, and a plurality of corresponding notches disposed on an inside periphery of a basket flange. To position the floating weir within the strainer basket, the projections on the weir are registered with the notches on the basket flange, and the weir is then inserted into the basket until the projections clear the underside of the basket flange. After insertion, the weir is rotated slightly, to move the respective projections and notches out of alignment. Subsequently, the floating weir is prevented from rising completely above the basket flange, when the projections engage the underside of the flange.

The floating weir and strainer basket of the present invention, when used in conjunction with an appropriate skimmer, is a combination which is capable of easy installation in the skimmer, and facilitates the removal of the strainer basket for cleaning without requiring the operator to submerge his hand below pool water level. Perhaps more importantly, the aforementioned problems relating to misalignment or disassociation of the floating weir with respect to the strainer basket are completely obviated, and problems associated with the suction pump drawing air into the pumping system are thereby minimized.

The above and other objects and advantages of this invention will become apparent from the following more detailed description, when taken in conjunction with the accompanying drawings of an illustrative embodiment.

DESCRIPTION OF THE DRAWINGS

FIG. 1 is a perspective view, partly in section, of the improved floating weir and strainer basket combination of the present invention shown in relation to a pool skimmer;

FIG. 2 is a perspective view, partly in section, illustrating the manner in which the improved floating weir and strainer basket of FIG. 1 may be conveniently removed from the pool skimmer;

FIG. 3 is an enlarged perspective view, partly in section, of the floating weir and the strainer basket shown with the floating weir separated from the strainer basket;

FIG. 4 is a sectional view, taken substantially along the line 4—4 in FIG. 3;

FIG. 5 is an enlarged fragmentary sectional view taken along a radial line through an annular portion of the weir and basket combination, with the weir being shown partially inserted in the basket;

FIG. 6 is a sectional view similar to FIG. 5, but with the weir being shown fully inserted in the basket; and FIG. 7 is an enlarged fragmentary sectional view taken substantially along line 7—7 in FIG. 6.

DESCRIPTION OF THE PREFERRED EMBODIMENT

Referring now to the drawings, FIGS. 1, 2 and 3 illustrate the general construction of an improved skimmer device for use in relatively large water containers, such as swimming pools, and the use of an improved floating weir and strainer basket combination in accordance with a presently preferred embodiment of the present invention. The combination is shown as having an open-ended cylindrical floating weir 11 and a cylindrical strainer basket 12, which cooperate, when suitably positioned in a skimmer 13, to remove surface water and accompanying debris from a pool.

FIG. 1 illustrates the manner in which the floating weir 11 and the strainer basket 12 are positioned within a self-adjusting, recirculating, overflow skimmer device 13. The skimmer device 13 comprises a tank 13*a* adapted to receive the strainer basket 12 and floating weir 11 in telescoping relation with each other. Further, the skimmer device includes a rectangular channel 14 through which pool water containing surface debris flows from the pool. The water is filtered by the strainer basket 12 before entering an outlet pipe 15 connected to a pool suction pump (not shown), for subsequent return to the pool.

In more detail, as shown in FIG. 3, the cylindrical floating weir 11 has an open top end 11*a*, an open bottom end 11*b* and a cylindrical wall 11*c* with an outside diameter slightly less than the inside diameter of the strainer basket 12. Further, the floating weir 11 includes a top flange 11*d* and a short cylindrical wall 16 depending from the innermost edge of the flange, and spaced inwardly from the wall 11*c*. The strainer basket 12, also shown in FIG. 3, includes an open top end 12*a*, a basket flange 12*b* surmounting the top end, a meshed cylindrical wall 12*c* and a meshed closed end 12*d*.

Accordingly, as shown in FIG. 1, when the skimmer device 13 is suitably positioned in the pool, the floating weir 11 is buoyed by a pocket of air formed by the short cylindrical wall 16 depending from the innermost edge of the flange of the floating weir 11. The weir 11 is thereby enabled to move vertically in response to changes in water level.

The flow of water through the strainer basket 12 is regulated by the floating weir 11, which is mounted for vertical movement in the basket 12, within the skimmer tank 13*a*. There is sufficient clearance between the cylindrical wall 11*c* of the floating weir 11 and inner edge of the basket flange 12*b*, after insertion of the weir in the basket, to permit free upward and downward movement of the weir as the water level in the skimmer changes.

Together, the floating weir 11, strainer basket 12 and tank 13*a* of the skimmer device 13 form an open chamber in which a quantity of the pool water is segregated from the main body of water in the pool. The chamber varies in size with changes in depth of the water in the pool, and this variation causes upward or downward movement of the floating weir 11. By withdrawing liquid continuously from the tank 13*a*, a difference between the water levels of the pool and tank 13*a* is created. The difference in water levels affects the equilibrium of the floating weir 11, which floats below the water level of the pool but above the water level of the tank 13*a*. As a result, a top layer of water spills over the top of the floating weir 11 and into the chamber, from which it is withdrawn by the suction pump through the outlet pipe 15 at the bottom of the tank 13*a*. Accordingly, the floating weir automatically adjusts itself to the difference in water levels created by the withdrawal of liquid from the chamber.

In accordance with the invention, and as shown in FIGS. 3 and 4, the floating weir 11 and strainer basket 12 include means for disengageably retaining the weir in the basket, to prevent misalignment or disassociation of the weir with respect to the basket. In a presently preferred embodiment, the disengageable retaining means comprises at least three equally spaced projections 17 disposed on the outer wall surface 11*c* of the floating weir 11, and at least three equally spaced corresponding notches 18 disposed on the inside periphery of the flange 12*b* on the strainer basket 12. As shown in FIGS. 4 through 7, to position the floating weir 11 within the strainer basket 12, the projections 17 are registered with the notches 18 on basket flange 12*b*, and the weir 11 is then inserted into the basket until the projections clear the underside of the basket flange.

After insertion, as shown in FIGS. 6 and 7, the weir 11 is rotated slightly so that the respective projections 17 and notches 18 are no longer aligned. The floating weir 11 is thus prevented from rising completely above the basket flange 12*b* by the engagement of the projections 17 on the undersurface of the flange 12*b*.

To prevent inadvertent alignment of the projections 17 and notches 18 after the weir 11 has been installed in the strainer basket 12, two depending ribs 19*a* and 19*b* are preferably formed on the undersurface of the flange 12*b*, as best shown in FIG. 3. The ribs 19*a* and 19*b* depend from the undersurface, one on each side of one of the notches 18. One rib 19*a* extends to the bottom of the basket 12, and the other rib 19*b* extends a substantial distance, but not all the way to the bottom of the basket. If the weir should rise up until the projections 17 engage the flange 12*b*, as shown in FIGS. 6 and 7, subsequent alignment of the projections and notches is then prevented by one of the ribs 19*a* and 19*b*.

It will be noted in FIG. 1 that, upon installation of the floating weir 11 and the strainer basket 12, in the skimmer device 13, surface debris from the pool water will accumulate in the strainer basket 12 due to the continuous recirculation of pool water through the skimmer 12. Hence, as best observed in FIG. 2, by lifting a skimmer lid 20 and grasping the floating weir 11, the strainer basket 12 and all of the debris accumulated in it can be removed with the weir without having to reach below the water level in the tank 13*a*.

The weir and strainer basket are typically fabricated of relatively strong molded plastic, so as to be not easily broken. As best observed in FIGS. 3, 4, and 7, the disengageable retaining means associated with the floating weir 11 and strainer basket 12 combination is preferably integrally constructed with the elements of the combination, in the form of three equally spaced pointed projections 17 and three equally spaced correspondingly indented notches 18. However, the respective projections 17 and notches 18 may be of any suitable configurations, and the projections may be installed on the outer wall surface 11c of the weir by any appropriate process, such as by ultrasonic welding or by placing the weir in a suitable mold and molding the projections to the main body of the weir.

Accordingly, it will be appreciated from the foregoing that the weir and basket of the present invention are of rugged, reliable and economical construction. More importantly, use of the invention assures proper alignment and positioning of the weir within the strainer basket, and prevents disassociation of the weir from the basket. Moreover, related problems involving possible damage to the suction pump are minimized.

It will be apparent from the foregoing that, while particular forms of the invention have been illustrated and described, various modifications can be made without departing from the spirit and scope of the invention. Accordingly, it is not intended that the invention be limited, except as by the appended claims.

I claim:

1. A floating weir and strainer basket combination for use with a swimming pool skimmer device and the like, the device having a tank adapted to receive the floating weir and strainer basket in telescoping relation with each other, said combination comprising:

an open-ended floating weir having a top end with a flange, a bottom end, and an intermediate wall;

a strainer basket having an open top end with a flange, and a closed but perforated bottom; and retaining means associated with said floating weir and said strainer basket, for disengageably retaining said weir in said basket, to prevent inadvertent disassociation of said weir from said basket while permitting free telescoping movement of said weir in said basket, wherein said retaining means for disengageably retaining said weir in said basket includes a plurality of projections disposed on the outer surface of said intermediate wall of said floating weir, a plurality of corresponding notches disposed on an inside periphery of said strainer basket flange, whereby said weir is inserted in said basket by aligning said projections and notches, and is prevented from subsequent inadvertent removal by rotation of said weir to move said projections and notches out of alignment and grooved rib means affixed inside said strainer basket and extending down from at least one of said notches to prevent realignment of said notches and projections.

2. A floating weir and strainer basket combination for use with a swimming pool skimmer device and the like, the device having a tank adapted to receive the floating weir and strainer basket in telescoping relation with each other, said combination comprising:

an open-ended floating weir having a top end with a flange, a bottom end and an intermediate wall;

a strainer basket having an open top end with a flange, and a closed but perforated bottom; and retaining means associated with said floating weir and said strainer basket, for disengageably retaining said weir in said basket, to prevent inadvertent disassociation of said weir from said basket while permitting free telescoping movement of said weir in said basket, wherein said retaining means for disengageably retaining said weir in said basket includes at least three equally spaced projections disposed on the outer surface of said intermediate wall of said floating weir, at least three equally spaced corresponding notches disposed on an inside periphery of said strainer basket flange, and at least one pair of downwardly depending ribs on the underside of said strainer basket flange adjacent to one of said notches, whereby said weir is inserted in said basket by aligning said projections and notches, and is prevented from subsequent inadvertent removal by rotation of said weir to move said projections and notches out of alignment, and by engagement of one of said projections with said rib.

3. The floating weir and strainer basket combination of claim 2, wherein said weir and said basket are of molded plastic.

4. A floating weir and strainer basket combination for use with a water skimming device, the device having a tank adapted to receive the floating weir and strainer basket in telescoping relation with each other, said combination comprising:

a strainer basket having an open top end and a closed but perforated bottom;

a floating weir fitted in inside telescoping relation with said strainer basket, to admit skimmed water and surface debris into said basket; and retaining means associated with said weir and basket, to maintain said weir in parallel telescoping relation with said basket, without unwanted tilting or jamming of said weir as it floats upwardly with respect to said basket, wherein said retaining means includes a plurality of projections disposed on an outer wall surface of said floating weir, a plurality of corresponding notches disposed on an inside periphery of said strainer basket, and ground rib means affixed to said strainer basket and extending down from at least one of said notches for preventing inadvertent alignment of said projections with said notches, and therefore preventing inadvertent disassociation of said weir and said basket whereby said projections function to prevent tilting or jamming of said weir, and also to allow said basket to be lifted out with said weir for cleaning.

5. A floating weir and strainer basket combination for use with a water skimming device, the device having a tank adapted to receive the floating weir and strainer basket in telescoping relation with each other, said combination comprising:

a strainer basket having an open top end and a closed but perforated bottom;

a floating weir fitted in inside telescoping relation with said strainer basket, to admit skimmed water and surface debris into said basket; and retaining means associated with said weir and basket, to maintain said weir in parallel telescoping relation with said basket, without unwanted tilting or jamming of said weir as it floats upwardly with respect to said basket, wherein said retaining means includes a plurality of projections disposed on an outer wall surface of said floating weir, a plurality of corresponding notches disposed on an inside periphery of said strainer basket; and means affixed to said strainer basket, for preventing inadvertent alignment of said projections with said notches, and therefore preventing inadvertent disassociation of said weir and said basket;

and wherein said means for preventing inadvertent alignment of said projections with said notches includes at least one pair of ribs disposed one on each side of one of said notches and extending in a direction generally parallel to the direction of telescoping movement of said weir, to prevent realignment of said projections with said notches unless said weir is fully inserted into said basket;

whereby said projections function to prevent tilting or jamming of said weir, and also to allow said basket to be lifted out with said weir for cleaning, and whereby said weir is installed in said basket by aligning said projections and notches, telescopically sliding said weir fully into said basket, and rotating said weir to move said notches and projections out of alignment.

* * * * *

UNITED STATES PATENT AND TRADEMARK OFFICE

CERTIFICATE OF CORRECTION

PATENT NO. : 4,212,740

DATED : July 15, 1980

INVENTOR(S) : Nat Greene

It is certified that error appears in the above-identified patent and that said Letters Patent are hereby corrected as shown below:

Column 1, line 12, delete "self-adjustment" and insert therefor --self-adjusting--.

Column 6, line 42, delete "ground" and insert therefor --grooved--.

Signed and Sealed this

*Fourteenth* Day of *October 1980*

[SEAL]

*Attest:*

SIDNEY A. DIAMOND

*Attesting Officer*

*Commissioner of Patents and Trademarks*